United States Patent [19]

Lonardo

[11] Patent Number: 5,005,231

[45] **Date of Patent: * Apr. 9, 1991**

[54] MEANS FOR POSITIONING BEDFAST PATIENTS

[75] Inventor: Robert Lonardo, Treasure Island, Fla.

[73] Assignee: Robert Lonardo, Trustee of the Robert Lonardo Living Trust Agreement, Treasure Island, Fla.

[ * ] Notice: The portion of the term of this patent subsequent to Oct. 10, 2006 has been disclaimed.

[21] Appl. No.: 413,230

[22] Filed: Sep. 27, 1989

Related U.S. Application Data

[63] Continuation of Ser. No. 202,532, Jun. 6, 1988, Pat. No. 4,872,226.

[51] Int. Cl.[5] ..... A61G 7/10

[52] U.S. Cl. ..... 5/61; 5/81 R

[58] Field of Search ..... 5/61, 81 R, 424, 508, 5/82 R; 24/199, 318

[56] References Cited

U.S. PATENT DOCUMENTS

| | | | |
|---|---|---|---|
| 2,788,530 | 4/1957 | Ferguson | 5/82 R |
| 3,829,914 | 8/1974 | Treat | 5/81 R |
| 4,180,879 | 1/1980 | Mann | 5/61 |
| 4,536,903 | 8/1985 | Parker | 5/61 |
| 4,675,925 | 6/1987 | Littleton | 5/61 |
| 4,744,115 | 5/1988 | Marchione | 5/81 R |

*Primary Examiner*—Alexander Grosz

*Attorney, Agent, or Firm*—Zarley, McKee, Thomte, Voorhees & Sease

[57] ABSTRACT

A method and means for positioning bedfast patients where the apparatus includes a rectangular pad which dwells on the bed surface and extends at least from above the shoulders of the patient to a point at least below the hip areas. Pairs of straps are secured to the pad and extend transversely across the pad in substantial alignment with the shoulders and hip areas, respectively, of the patient. Hand gripping loops are formed in the strap elements adjacent the side edges of the pad. Slide buckles are secured to the strap elements which extend outwardly from the side edges of the pad, and hook elements are secured thereto for securement to bed rails and the like to temporarily hold a patient in a side rest position, for example. The method involves exerting pulling pressure on various of the straps of the pad to engage the hip or shoulder of the patient to effect movement of the patient from a back rest position to a side rest position; longitudinally moving the patient on a bed surface; or moving the patient to a sitting position.

3 Claims, 3 Drawing Sheets

MEANS FOR POSITIONING BEDFAST PATIENTS

This application is a continuation of co-pending application Ser. No. 202,532, filed June 6, 1988 now U.S. Pat. No. 4,872,226.

BACKGROUND OF THE INVENTION

Invalid bedfast patients must be moved from position to position at least every two hours to prevent the occurrence of bed sores. Thus, a patient in a back rest position must be rolled to one side or the other periodically to prevent bed sores from occurring through lack of circulation at pressure points on the body.

Semi-invalid patients have a tendency to migrate longitudinally on the bed surface from the head of the bed towards the foot of the bed, particularly when the head of the bed is slightly elevated. It is common that such a patient will have to be moved upwardly towards the head of the bed up to 16 times in a 24-hour period.

It is often extremely difficult to reposition such patients as described above, or to occasionally move them to a sitting position on the bed. Statistically, 50% to 60% of all nursing injuries occur while they are turning or repositioning patients. Many times, two nurses are required to perform the repositioning function. Because of the difficulty in repositioning a patient, and because of the back injuries frequently experienced by nurses in performing this function, some patients are not moved as often as they should be.

It is, therefore, the principal object of this invention to provide a method and means for positioning bedfast patients which will not likely incur back injuries to the nurses performing the repositioning function.

A further object of this invention is to provide a method and means of positioning bedfast patients which will not be harmful to the patients themselves.

A further object of this invention is to provide a method and means of positioning bedfast patients whereby the patients can be easily moved longitudinally in the bed, rolled from side to side, or moved to a sitting position.

These and other objects will be apparent to those skilled in the art.

SUMMARY OF THE INVENTION

This invention utilizes a rectangular pad means which dwells on the bed surface and extends at least from above the shoulders of the patient to a point at least below the hip areas. Pairs of straps are secured to the pad means and extend transversely across the pad means in substantial alignment with the shoulders and hip areas, respectively, of the patient. Hand gripping loops are formed in the strap elements adjacent the side edges of the pad means. Slide buckles are secured to the strap elements which extend outwardly from the side edges of the pad means, and hook elements are secured thereto for securement to bed rails and the like to temporarily hold a patient in a side rest position, for example.

The straps should be located at the pelvic girdle between the lessor trochanter of the hip joint and the crest of the ilium at the waist within the base of the ilium bones on both sides of the body. This space defines approximately eight inches, and the strap element functioning in conjunction with the hip area can suitably work within that eight-inch space.

The upper strap is located at the shoulder girdle approximately two inches above the inferior angle of the scapula and in a vertical line with the axilla of the arm. This provides an allowed space of approximately six inches, so as to allow the pulling of the strap to exert force directly around the entire shoulder section that also includes the head and the arms, all of which are attached to the shoulder girdle.

These portions of the upper torso are the largest and heaviest parts of the human anatomical body, and the moving force exerted on the patient is eased by pulling on these straps located in the shoulder and hip areas since all skeletal bones, including the spinal column, are attached to both structures.

By utilizing loops attached to the straps attached to the side edges of the pad means, the person doing the repositioning can stand substantially upright while pulling the patient or changing the patient's position. A single person can perform this manipulation with 80% less effort than done by conventional means, and this is normally accomplished merely by the nurse leaning in the direction of the pulling action.

DESCRIPTION OF THE PREFERRED EMBODIMENT

Figure 1:
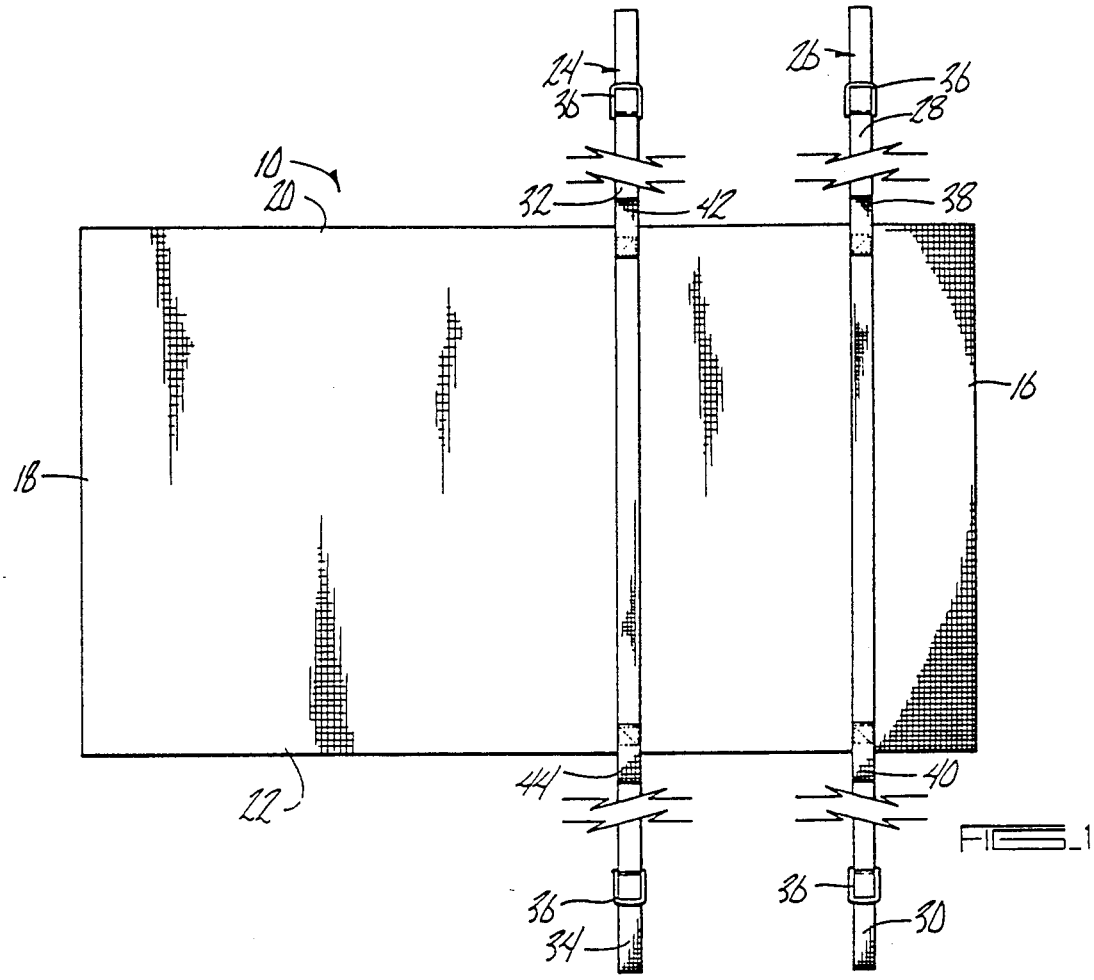
FIG. 1 is a bottom plan view of the pad.
Figure 2:
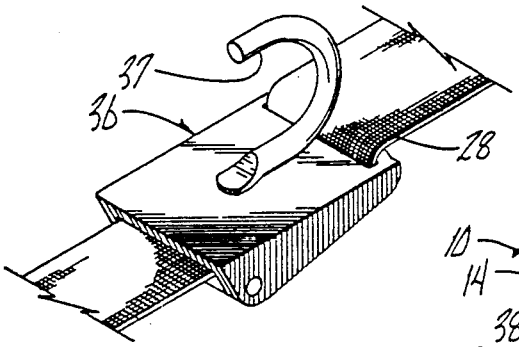
FIG. 2 is an enlarged scale perspective view of a buckle used on the straps.
Figure 3:
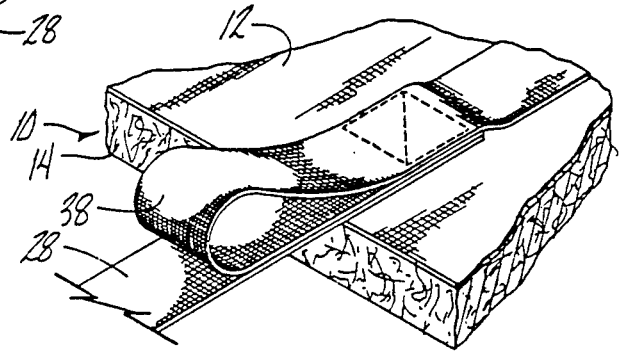
FIG. 3 is an enlarged scale perspective view of one of the gripping loops.
Figure 4:
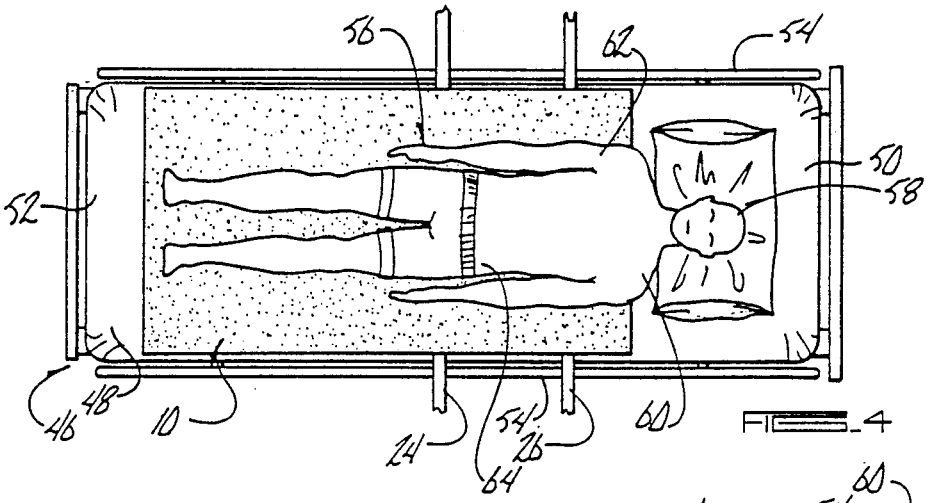
FIG. 4 is a plan view of an invalid patient lying on the pad which is positioned on the bed surface of a typical hospital bed.
Figure 5:
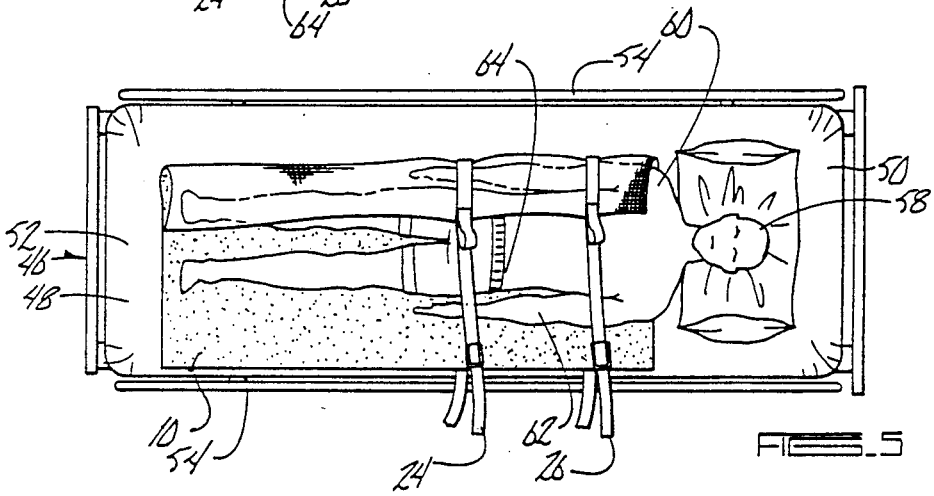
FIG. 5 is a view similar to that of FIG. 4 but shows the strap elements in an intermediate position preparatory to rotating the patient from a back rest position to a side rest position.

The numeral 10 designates the pad of this invention which is comprised of Kodel brand material consisting of base sheet 12 and a fleece-type padding material 14. The pad 10 has a head end 16 which preferably should be 35" in length. The numeral 18 designates the foot end of the pad. Parallel sides 20 and 22 should be approximately 60" in length. A pair of straps 24 and 26 are approximately 110" long and are secured to the base sheet 12 by stitching or the like. Strap 26 is comprised of strap elements 28 and 30, and strap 24 is comprised of strap elements 32 and 34. Conventional slidable buckles 36 with open U-shaped hook elements 37 secured thereto are slidably affixed to each of the strap elements.

Loops 38, 40, 42 and 44 are secured to each of the strap elements 28, 30, 32 and 34, respectively, and are secured to the strap elements by stitching or the like approximately $1\frac{3}{4}''$ from the sides 20 and 22 of the pad 10. Strap 24 is approximately 7" from the head end 16 of the pad 10, and there is approximately 15" between the pairs of straps 24 and 26.

Figure 6:
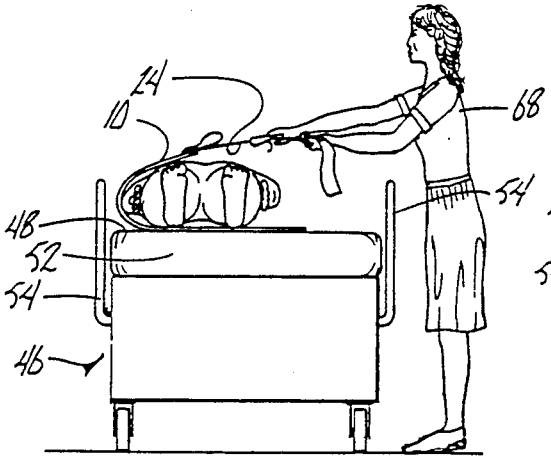
FIG. 6 is an end view of the bed of FIG. 5 showing a nurse just before rotating a patient from a back rest position to a side rest position.
Figure 7:
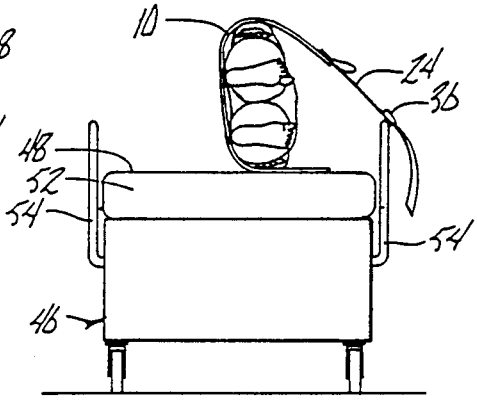
FIG. 7 is a view similar to that of FIG. 6, but shows the patient moved to the side rest position and secured in that position.

The numeral 46 designates a conventional hospital bed having a bed surface 48, a head end 50, a foot end 52, and side rails 54 (See FIGS. 6 and 7). The numeral 56 designates an invalid patient having a head 58, a shoulder area 60, arms 62, and a hip area 64. The numeral 68 designates a nurse who is involved in the repositioning activity.

FIGS. 4, 5, 6 and 7 show the steps where a patient is moved from a back rest position to a side rest position. With a patient in the back rest position of FIG. 4, the strap elements 28 and 32 are moved to the positions shown in FIG. 5 across the body of the patient. With reference to FIG. 6, the nurse 68 pulls on the strap elements 28 and 32 and causes the patient to rotate to the side rest position of FIG. 7. The position of the buckles 36 on the strap elements can be moved and locked to an appropriate position, and the hooks 37 thereon can be hooked on rail 54 of the hospital bed to maintain the patient in the side rest position. As indicated in FIG. 7, this position is best maintained if the weight of the patient is allowed to be exerted against the strap element.

Figure 8:
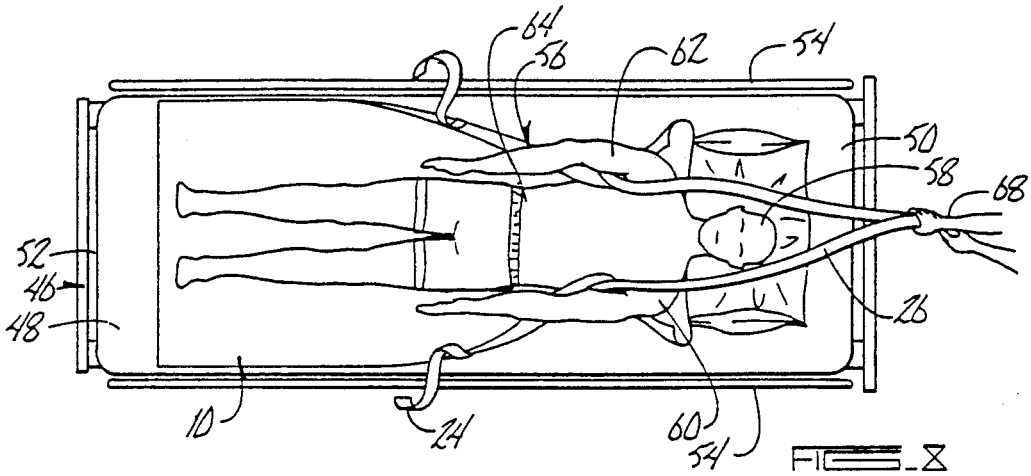
FIG. 8 is a plan view of a patient similar to that of FIG. 4 but shows the apparatus of this invention being used to longitudinally move the patient toward the head of the bed.
Figure 9:
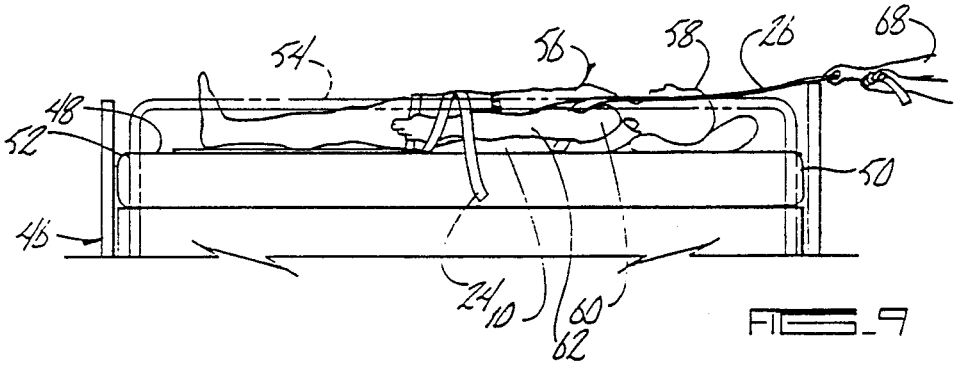
FIG. 9 is an elevational view of the bed of FIG. 8 during the patient's sliding operation.

When it is desired to move the patient longitudinally towards the head of the bed after the patient has migrated towards the foot of the bed, the strap elements 28 and 30 are threaded underneath the arms of the patient and extended towards the head of the bed. This is shown in FIG. 8. The nurse 68, as shown in FIG. 9, can then go to the head of the bed, and pull on the strap elements 28 and 30, and the patient and the pad 10 can easily be moved towards the head of the bed.

Figure 10:
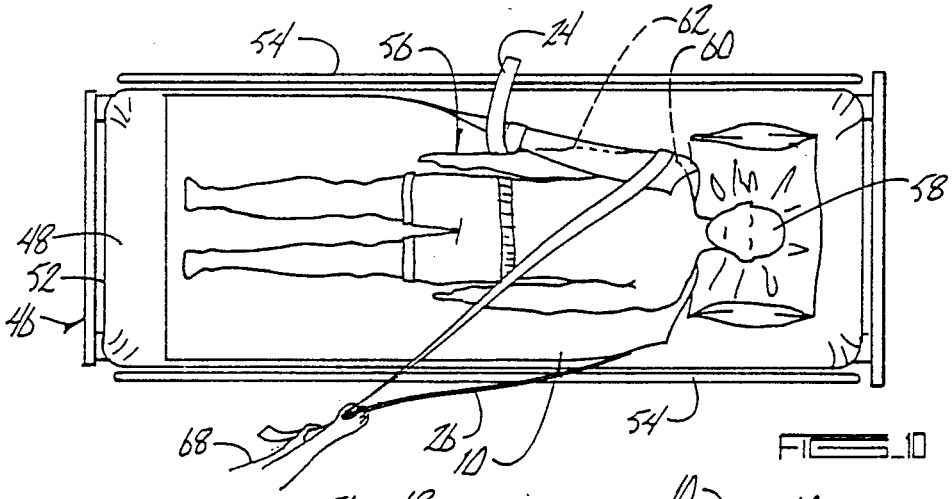
FIG. 10 is a plan view similar to that of FIG. 8 but shows the apparatus of this invention being used to moved a patient to a sitting position.
Figure 11:
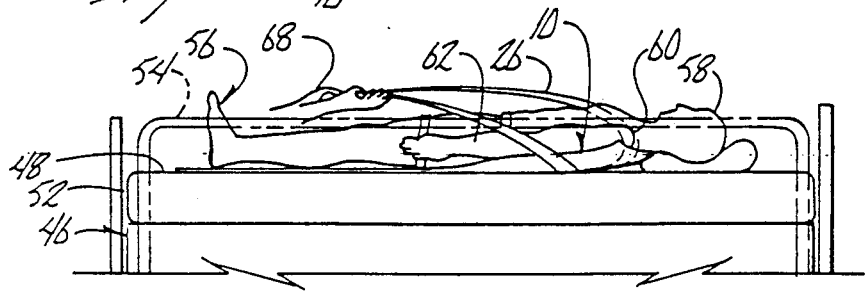
FIG. 11 is an elevational view of the phenomenon taking place in FIG. 10.

When it is desired to move the patient to a sitting position, the strap elements 28 and 30 are wrapped around the outside of the person's upper arms and shoulders as shown in FIG. 10. The nurse, by sitting towards the foot of the bed, can then pull the straps towards the foot of the bed which causes the patient to rise to a sitting position. By then grasping one of the loops 38 or 40, the patient and pad 10 can be pivoted on the bed surface, so that the patient's feet and lower legs can extend downwardly over the edge of the bed. Obviously, the bed rail would have to be removed for this latter activity.

An important aspect of this invention is that the strap elements described engage the shoulder and/or the hip areas of the patient, as defined above, and by concentrating the pulling pressure on these massive areas, and by utilizing the leverages afforded by the various strap elements, a nurse of modest stature can move even a heavy patient to accomplish the various repositioning requirements.

It is, therefore, seen that this invention will accomplish at least all of its stated objectives.

I claim:

1. A bedfast patient positioning device, comprising:

a substantially rectangular pad means adapted to extend over a patient's bed underneath a bedfast patient, said pad means having opposite parallel sides, and upper and lower surfaces, a pair of separate continuous straps secured to the bottom surface of said pad means and extending transversely across the width of said pad means and extending outwardly from said opposite parallel sides thereof, and terminating in straight elongated end portions, said pair of continuous straps being spaced apart and one each thereof being adapted to be substantially aligned with a patient's shoulder and hip areas, respectively, a pair of gripping loops secured to said pair of straps substantially adjacent the opposite parallel sides of said pad means inwardly from the end portions of said straps, said straps extending outwardly beyond said gripping loops and fastening means positioned on each strap outwardly from said gripping loops, said fastening means adapted to selectively secure said straps to the bed so as to maintain the patient in a selected position.

2. The device of claim 1 wherein said fastening means is a hook on each strap.

3. The device of claim 2 wherein said fastening means further includes an adjustable mounting means for adjustably securing said hook on said strap.

* * * * *